US006905192B2

(12) United States Patent
Rasmussen

(10) Patent No.: US 6,905,192 B2
(45) **Date of Patent: *Jun. 14, 2005**

(54) SYSTEM AND METHOD FOR POSITIONING PRINT HEADS BASED ON PRINT JOB

(75) Inventor: Steve O. Rasmussen, Vancouver, WA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/653,504

(22) Filed: Sep. 2, 2003

(65) Prior Publication Data

US 2004/0085383 A1 May 6, 2004

Related U.S. Application Data

(63) Continuation of application No. 10/284,954, filed on Oct. 31, 2002, now Pat. No. 6,739,687.

(51) Int. Cl.[7] ..... B41J 2/145
(52) U.S. Cl. ..... 347/40

(58) Field of Search ..... 347/40, 8, 14, 347/19, 5, 38, 42, 10, 16, 9, 7

(56) References Cited

U.S. PATENT DOCUMENTS

| | | | | |
|---|---|---|---|---|
| 4,977,410 | A | 12/1990 | Onuki et al. | |
| 5,589,868 | A | 12/1996 | Schofield et al. | |
| 5,943,083 | A | 8/1999 | Defieuw | |
| 5,966,149 | A | 10/1999 | Kamada et al. | |
| 6,113,232 | A | 9/2000 | Belon et al. | |
| 6,155,680 | A | 12/2000 | Belon et al. | |
| 6,290,316 | B1 | 9/2001 | Buckby | |
| 6,739,687 | B1 * | 5/2004 | Rasmussen et al. | 347/14 |

* cited by examiner

*Primary Examiner*—Stephen Meier
*Assistant Examiner*—Charles Stewart, Jr.

(57) ABSTRACT

Disclosed is a printing system having a plurality of print heads for printing an image on a print receiving medium, print head actuators operable for individually repositioning the print heads to optimal locations for each print job, and software operable while a current print job is active for determining the optimal print head locations for a next anticipated print job.

13 Claims, 2 Drawing Sheets

SYSTEM AND METHOD FOR POSITIONING PRINT HEADS BASED ON PRINT JOB

CROSS-REFERENCE TO RELATED APPLICATIONS

This application is a continuation of U.S. patent application Ser. No. 10/284,954 filed Oct. 31, 2002, now U.S. Pat. No. 6,739,687 entitled "SYSTEM AND METHOD FOR POSITIONING PRINT HEADS BASED ON PRINT JOB," the disclosure of which is hereby incorporated herein by reference.

FIELD OF THE INVENTION

The present invention relates to printing devices used by computer systems and more specifically to printing devices that are configured to position the print heads for the expected printed output.

DESCRIPTION OF RELATED ART

There are many types of printing devices for computer systems including laser printers, pen plotters, scanning head printers, impact printers and ink jet printers. Laser printers create an image by placing a charge onto a drum that attracts colorant particles, or toner, and transferring the colorant particles onto a sheet of paper. The sheet of paper is then passed through a fuser where the colorant is fused or melted onto the paper.

A pen plotter draws lines on a medium by moving a pen relative to a sheet of paper. By moving the pen in a scanning direction and moving the medium in a perpendicular direction, a two-dimensional image is created. A pen plotter may be used to create line drawings of any type, or area fills, by drawing lines right next to one another. In pen plotters, color images may be created by the use of different color pens. Typically, two to eight different color pens are used.

In a scanning head system both the print head and the paper (or, more generally, the print medium) are moved independent of each other. In this system, the print head is scanned across the medium and then the medium is advanced. Once the medium has been advanced, the print head is scanned for a next pass. A variation on a scanning head printer is to hold the printing device (such as a pen in an ink jet printer) stationary and pass the medium under the print head. These devices are referred to as fixed pin or fixed print head printing devices.

Impact printers use an ink bearing component, such as a ribbon, which is struck by a print head to write onto a printing surface. Typically, the print head moves along the width of the print medium and the print medium is transported longitudinally.

In an ink jet printer a jet of ink is projected out of a print head onto the surface of the object, such as paper, to be printed. The print head is moved along the surface of the print medium.

A printer utilizing a fixed print head keeps, as the name implies, the print head stationary and passes the paper or print medium under the print head to form an image. Movement of the print media may vary from system to system; in some systems the medium is moved back and forth several times to create additional details in the image. See, for example, U.S. Pat. Nos. 6,113,232 and 6,155,680, both of which are incorporated herein by reference in their entirety, which describe stationary pen ink jet printers.

In fixed pen printing systems, those in which printing is accomplished with a single pass of the medium under the pen or print head, the size of the printed image is limited by the size of the printing device, for instance the size of a nozzle array. The size of the printed image may be increased by using multiple print heads or pens positioned in sequence, effectively employing a larger print head. Such systems are described in, for example, U.S. Pat. Nos. 4,977,410; 5,589,868; 5,943,083; 6,290,316; and 5,966,149, all of which are incorporated herein by reference in their entirety, describing use of a plurality of print heads or a segmented or divided line head to print a full line across a page. Each of these methods increase the cost, complexity, and size of the printing device. Typically in each of these printing devices, the printable portion of the paper is determined by the location of the print head or pen with respect to the medium. In order to allow printing over the entire paper, numerous print heads, or one extended print head, can be constructed along one edge of the paper. With this configuration, a single color can be printed along an entire page in a single pass of either the print heads or the paper.

With today's printing devices, printing on specialty media such as envelopes, labels or similar medium, requires either a versatile-multifunction printing device configured for the specific task, or requires a machine designed and dedicated specifically for that purpose. For example, a multi-purpose printer could be configured to print envelopes, or a printer can be purchased for printing envelopes.

BRIEF SUMMARY

One embodiment is directed to a printing system comprising a plurality of print heads for printing an image on a print receiving medium, print head actuators operable for individually repositioning the print heads to optimal locations for each print job, and software operable while a current print job is active for determining the optimal print head locations for a next anticipated print job.

Another embodiment is directed to a method for printing an image onto a print receiving medium comprising determining, while a current image is being printed, a desired subsequent printing position for one or more print heads, and repositioning, at the completion of the printing of the current image, one or more print heads to the desired subsequent printing position.

Another embodiment is directed to an apparatus for printing an image onto a print receiving medium comprising a plurality of print heads, means for repositioning each of said print heads from previous printing locations to desired print head locations in accordance with a determined desired print head location for each said print head on a print job by print job basis, means for determining said desired print head location for a next anticipated print job while a current print job is in process, and means for enabling said repositioning means immediately upon the conclusion of said current print job.

DETAILED DESCRIPTION

The current invention is a variation of a fixed pen device in that the pens remain fixed during the printing of a specific print job, but can move from a first position to alternate positions for the next print job. It should be appreciated that pens as referred to with respect to the present invention encompasses any form of print mechanism, including ink jet, laser, impact, and pen printing mechanisms.

The structure of the present invention reduces printer costs by minimizing the number and/or size of print heads included in a printer. Preferred embodiment printers may be connected electronically to a computer system in a conventional manner, e.g., using a standard serial or parallel printer interface or via a local area network and associated protocol. Positioning of print heads to desired printing positions may enable printing on a particular print receiving medium and/or in a particular format. In order for the print heads to be properly positioned, a signal may be sent to the control mechanism attached to the print heads, such as motors, which represents the amount of movement necessary for any or all of the print heads. Preferably, the print heads may be mounted in carriages that are configured to traverse a width of the print receiving medium, or some portion thereof, while the medium is transported in a longitudinal direction beneath the linear or staggered array of print heads. One method of determining the amount of movement necessary in the print heads is to determine the current position, determine the desired position, and to determine the amount and direction of movement necessary of the print heads.

Figure 1:
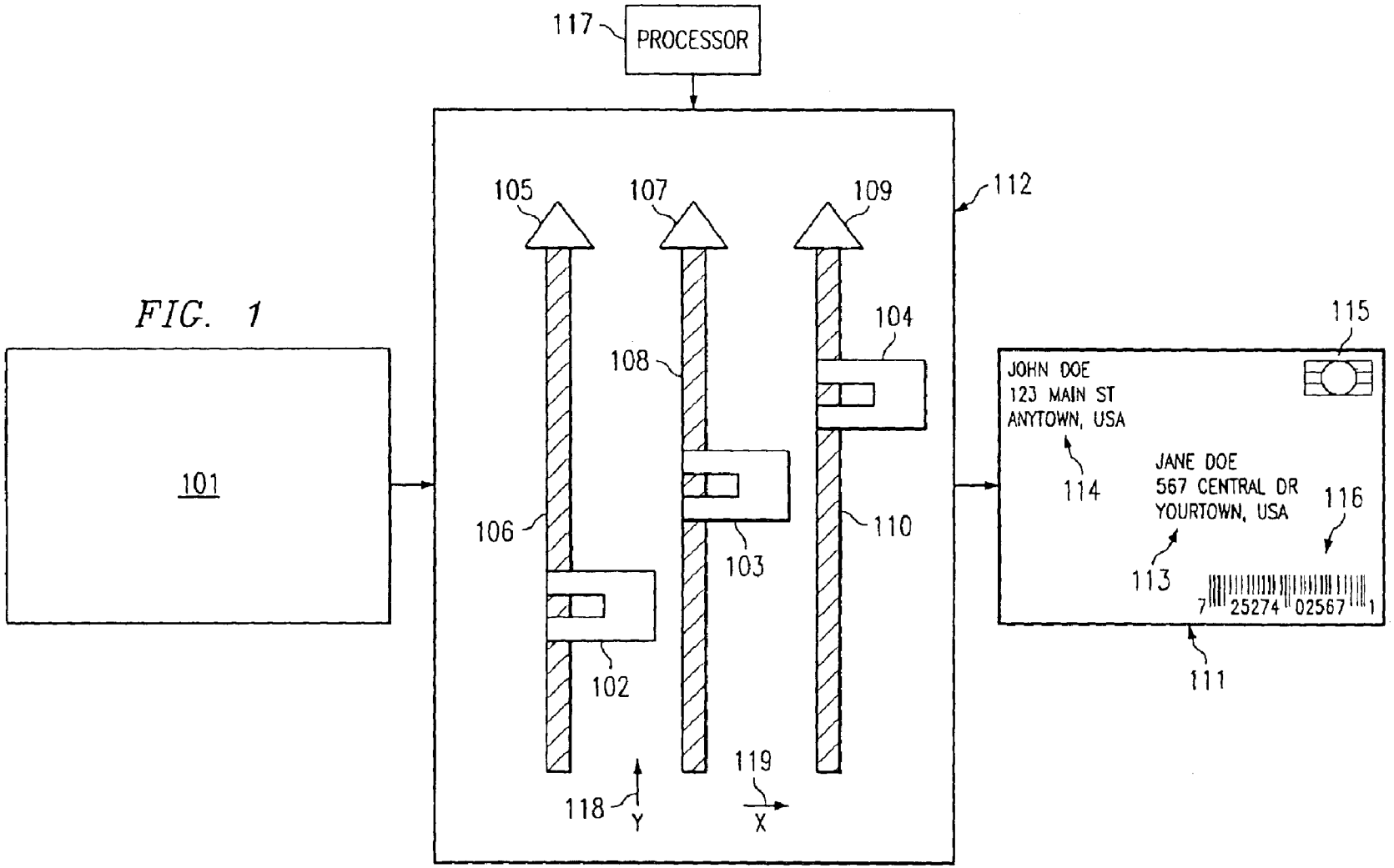
FIG. 1 is a block diagram illustrating one embodiment of print heads within a printing system which implements the current invention.

FIG. 1 is a diagram of one embodiment of a print system, including print heads, according to the current invention. In FIG. 1, information regarding a particular medium and associated print format, such as for envelope 101, may be provided to positioning software stored in and executed by processor 117. The software uses this information to calculate the desired positions for each of the print heads 102, 103 and 104.

Once determined, the positioning software instructs and/or controls actuators, such as positioning motors 105, 107 and 109 to reposition print heads 102, 103 and 104 respectively. For example, positioning motor 105 may reposition print head 102 by means of a track or guide 106. In one embodiment of the current invention, guide 106 may include a rod with a screw-like helical pattern along its circumference which enables positioning motor 105 to rotate guide 106 such that screw threads engage complimentary threads at print head 102, or any moveable carriage assembly into or on which print head 102 may be mounted. Thus, controlled rotation of guide 106 causes a linear translation of print head 102 in a direction perpendicular to a direction of movement of the print receiving media such that print head 102 is repositioned in the "Y" axis as shown by reference number 118, while the print receive medium (in this example, envelope 101) moves in the "X" axis, as shown by reference number 119.

In one embodiment of the present invention, the threads of rod 106 may be orientated so that a clockwise rotation of guide 106 moves print head 102 towards motor 105. The threads of 106 may be changed in such a manner that a clockwise rotation of rod 106 would move print head 102 away from motor 105. Similarly, motor 107 uses guide 108 to position print head 103, and motor 109 uses guide 110 to position print head 104. Each of the motors 105, 107 and 109 preferably receives positioning information from the positioning software run by processor 117. Processor 117 can be within printer 112, or within an external CPU or partially within each.

Still referring to FIG. 1, processing software resident on processor 117 may use the characteristics of printing medium 101 to determine the locations of print head 102, 103 and 104, such as may be determined by analysis of print stream information, possibly including document size information, transmitted to a printer hosting the print heads of the present invention. For example, processor 117 may analyze a print stream to determine a physical arrangement of the text and/or image to be printed in order to position one or more of print heads 102–104 and/or to select an appropriate print head. Moreover, processor 117 may analyze the print stream to determine a particular print head suitable for printing aspects of the print job and, therefore, place that print head accordingly. Additionally or alternatively, sensory input, such as may detect physical attributes of the selected printing medium, may be utilized by processor 117 in determining locations of print heads 102–104. In the embodiment illustrated in FIG. 1, print head 102 is used to print a bar code 116 on the printed medium 111. Similarly, print head 103 is used to print address 113 on printed medium 111 and print head 104 is used to print return address 114 and proof-of-postage 115 on printed medium 111.

Structure in addition, or in the alternative, to that shown in FIG. 1 may be utilized according to the present invention. For example, a brake mechanism may be provided upon a print head, a print head actuator, a print head guide, and/or a chassis component in order to hold the print head, actuator, and/or guide from movement when a print head has been properly positioned. According to one embodiment, a brake mechanism is disposed upon a print head and coupled to processor 117 to be controllably engaged when the print head has been positioned. Additionally or alternatively, the actuator may be controlled to hold a print head's position, such as by application of a holding voltage or current.

Figure 2:
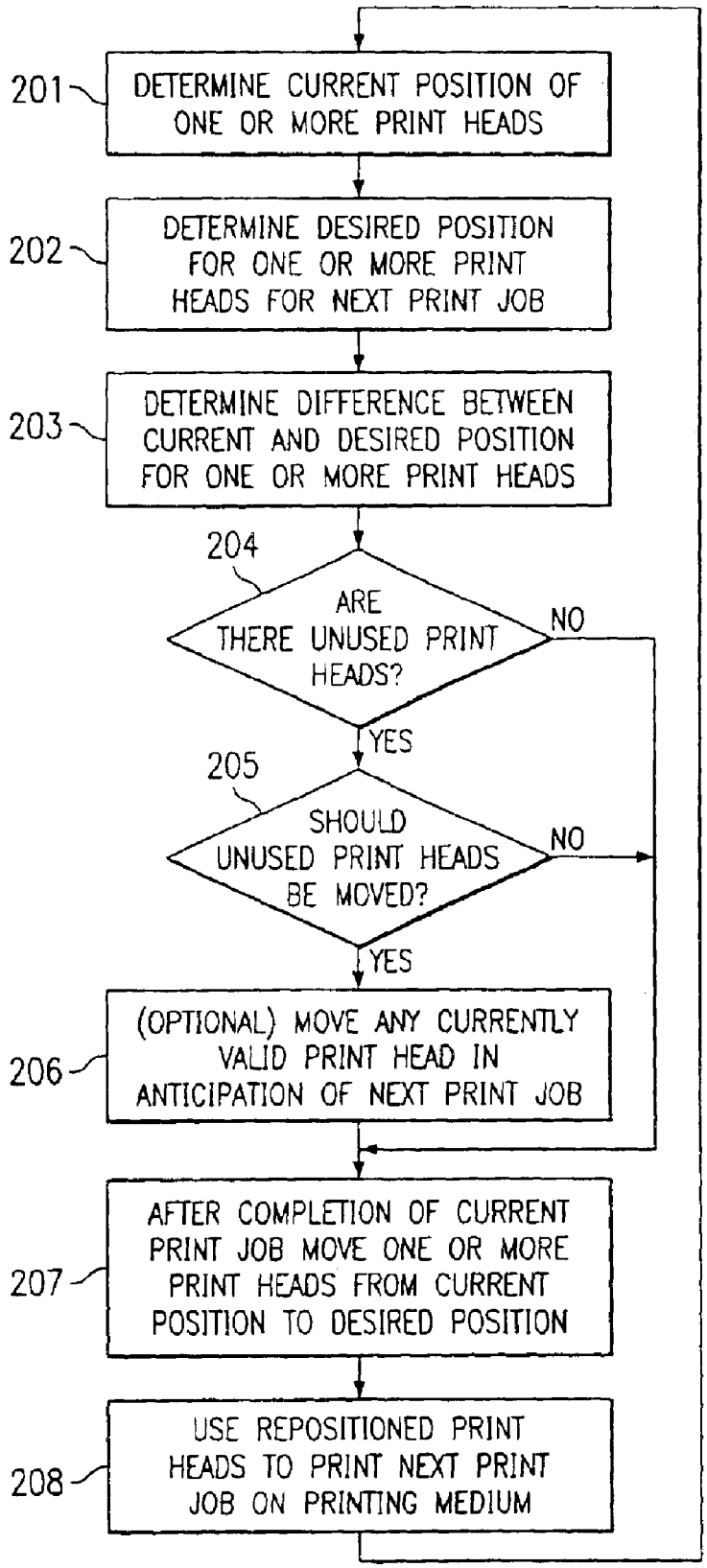
FIG. 2 is a flow chart illustrating the steps performed in one embodiment of the current invention.

The invention is further subject to being incorporated in different embodiments. For example, while the print heads are shown staggered along a direction of travel of the print receiving media, they may instead be aligned in a linear array within a common or concentric track or guide structure. Further, while translation of the print heads is described using a motor and screw arrangement, other positioning may be used including stepper motors, rack and pinion gear arrangement, belt and pulley system, etc. Still further, multiple heads and paper handling apparatus may be dynamically positioned in response to particular print job requirements. For example, a color print head may be positioned to insert a color segment into an otherwise monochromatic (e.g., black and white) printed document such as to print a small photograph within a document. Similarly, stapling may be adjusted by proper positioning of a stapling apparatus relative to a particular medium, size, format, and related requirements. Note that the size of the printed image may require the use of two or more print heads and that not all print heads need be used for each and every print job. Further note that any material that can be deposited from any type of print head could be used in this device such as "postal mark" ink, "barcode" ink and similar marking material FIG. 2 shows a chart illustrating the steps performed according to one embodiment of the current invention. Referring to the flow chart of FIG. 2, a determination of the current position of one or more print heads is performed at step 201. This determination may be made from sensors located along print head guides, from a position stored within the control mechanism, from a print head position stored within another system resource, or any other suitable method. A new desired position(s) for one or more print heads for the next print job is determined according to step 202.

The new positions preferably represent printing swaths required for the next identified print job. In particular, while the printer is printing the current print job, the print heads are positioned in a specific orientation to support the current print job. However, the next print job may require different print head positions. Thus, step 202 defines steps to gather information, or use information gathered, related to the next print job, or a queued print job, to determine the desired positions for the print heads. For instance, if the current print job is printing an address, a return address, and proof-of-postage for a wide envelope, the spacing between the print heads might need to be reduced in order to print the address, the return address, and the proof-of-postage on a narrow envelope. In step 202 the next queued (or anticipated) print job is examined to determine the characteristics of the next/expected print job. For example, if the next print medium is a narrow envelope, new positioning information for the print heads would be calculated to properly place the address, the return address, proof-of-postage and possibly a bar code on the narrow print medium.

In step 203, the differences between the current print head positions and the desired print head positions are calculated. These calculations are preferably to determine the movement desired for each of the print heads. Optional decision 204 determines if these are currently unused (inactive) print heads. If so, decision 205 determines if the unused print heads should be moved prior to completion of the current print job. If so, step 206 controls this process. If either decision 204 or 205 is no, (or not used), or when step 206 is finished, the process goes to step 207, where, after the current print job is completed, the print heads are moved from their current position to the desired position for the next queued print job. Once the print heads have been moved, at step 208 the next print job is printed on the print receiving medium.

The current invention may be applied to one or more print heads. For example, if the return address is preprinted on envelopes sent from a particular company, a single print head used to print recipient address information on the envelopes may be relocated to print address information onto the appropriate portion of both narrow envelopes and wide envelopes. Alternatively, more than one print head could be included in a printing system where the location of each of the print heads is determined in the flow chart of FIG. 2 as applied to position each of the print heads in a desired location. Also, if desired, a print head, or heads, not currently being used could be prepositioned to further reduce time between print jobs.

What is claimed is:

1. A printing system comprising:

a plurality of print heads for printing an image on a print receiving medium;

print head actuators operable for individually repositioning said print heads to optimal locations for each print job; and software operable while a current print job is active for determining said optimal print head locations for a next anticipated print job.

2. The printing system of claim 1 wherein said software supplies said position defining information to said print head actuators prior to the start of a next print job.

3. The printing system of claim 2 wherein at least a portion of said position defining information is provided to said print heads while said current print job is active.

4. The printing system of claim 1 wherein a print head of said print heads includes ink jet nozzles.

5. The printing system of claim 1 wherein a print head of said print heads includes pens.

6. The printing system of claim 1 wherein print head actuators each comprise guides defining a locus of operable locations for said print head, each said guides including a lead screw for positioning said associated print head.

7. The printing system of claim 1 including a brake mechanism configured to hold a print head of said print heads at a fixed location while an image is printed on the print receiving medium.

8. An apparatus for printing an image onto a print receiving medium comprising:

a plurality of print heads;

means for repositioning each of said print heads from previous printing locations to desired print head locations in accordance with a determined desired print head location for each said print head on a print job by print job basis;

means for determining said desired print head location for a next anticipated print job while a current print job is in process; and means for enabling said repositioning means immediately upon the conclusion of said current print job.

9. The apparatus of claim 8 wherein said determining means includes means for examining a print queue to determine an anticipated next print job.

10. The apparatus of claim 8 wherein said repositioning means is enabled for currently non-active ones of said print heads prior to the completion of said current print job.

11. The apparatus of claim 8 wherein a print head of said print heads includes ink jet nozzles.

12. The apparatus of claim 8 wherein a print head of said print heads includes pens.

13. The apparatus of claim 8 wherein said means for repositioning said print heads includes a lead screw which positions a print head of said print heads.

* * * * *